US005979019A

United States Patent [19]

Johnson

[11] Patent Number: 5,979,019

[45] Date of Patent: Nov. 9, 1999

[54] ADJUSTABLE BELT CLIP CONSTRUCTION

[76] Inventor: Desline Taylor Johnson, 2462 N. 19th St., Philadelphia, Pa. 19132

[21] Appl. No.: 09/218,669

[22] Filed: Dec. 22, 1998

[51] Int. Cl.[6] ..... A44B 11/00

[52] U.S. Cl. ..... 24/3.11; 224/269; 24/3.12

[58] Field of Search ..... 24/3.1, 3.11, 3.12, 24/168, 170, 171, 334, 336, 307; 224/163, 904, 269

[56] References Cited

U.S. PATENT DOCUMENTS

| | | | |
|---|---|---|---|
| 1,508,963 | 9/1924 | Dorf | 224/269 |
| 2,551,515 | 5/1951 | Tschirf | 24/3.12 X |
| 2,869,198 | 1/1959 | Clevett, Jr. | 24/3.12 |
| 3,623,189 | 11/1971 | Wilczynski | 24/3.11 |
| 4,280,254 | 7/1981 | Racke | 24/336 |
| 4,819,303 | 4/1989 | Udelhofen | 24/182 |
| 4,974,764 | 12/1990 | Cantwell | 224/269 |
| 5,044,049 | 9/1991 | Owens et al. | 24/182 |
| 5,333,361 | 8/1994 | Schaede | 24/182 |
| 5,640,742 | 6/1997 | White et al. | 24/3.12 |
| 5,779,115 | 7/1998 | Parkas et al. | 224/269 X |

*Primary Examiner*—James R. Brittain
*Assistant Examiner*—Robert J. Sandy
*Attorney, Agent, or Firm*—Henderson & Sturm

[57] ABSTRACT

An adjustable length belt clip construction 10 adapted to receive a plurality of belts 100 having different widths. The construction 10 includes a main clip unit 11 having a clip member 40 hingedly connected to a backing plate member 20 wherein both the clip member 40 and the backing plate member 20 are provided with extension elements 43 and 24, respectively, that can be adjusted to vary the effective length of the main clip unit 11. The backing plate member 20 is adapted to releasably receive different decorative face plate units 12.

8 Claims, 2 Drawing Sheets

ADJUSTABLE BELT CLIP CONSTRUCTION

BACKGROUND OF THE INVENTION

1. Field of the Invention

The present invention relates to the field of decorative accessories for belts in general, and in particular to an adjustable belt clip construction having removable decorative face panels.

2. Description of Related Art

As can be seen by reference to the following U.S. Pat. Nos., 4,280,254; 4,819,303; 5,044,049; and 5,333,361, the prior art is replete with myriad and diverse belt clip constructions.

While all of the aforementioned prior art constructions are more than adequate for the basic purpose and function for which they have been specifically designed, they are uniformly deficient with respect to their failure to provide a simple, efficient, and practical belt clip construction that has an adjustable length as well as a decorative face plate that is removable from the main clip housing.

As most fashion conscious people are all too well aware, standard belt clip constructions not only have a fixed decorative face panel, but are also designed to only accommodate a belt having a specific width.

As a consequence of the foregoing situation, there has existed a longstanding need for a new and improved type of adjustable belt clip construction whose height can be varied to accommodate different width belts, and the provision of such a construction is a stated objective of the present invention.

BRIEF SUMMARY OF THE INVENTION

Briefly stated, the adjustable belt clip construction that forms the basis of the present invention comprises in general, a main clip unit and a decorative face panel unit.

As will be explained in greater detail further on in the specification, the main clip unit comprises a clip member hingedly connected to a backing plate member that is adapted to releasably engage the decorative face panel unit. Both the clip member and the backing plate member are provided with extension elements which are designed to increase or decrease the effective length of the main clip unit to accommodate belts having different widths.

In addition, the decorative face panel unit comprises a face panel member having a decorative design on its front face. The rear face of the decorative panel member is provided with a pair of spring loaded catch elements that are designed to releasably engage the backing plate member such that a plurality of different decorative face panel units can be employed with the same main clip unit to coordinate the belt clip construction both with a given belt and the user's different outfits and/or accessories.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
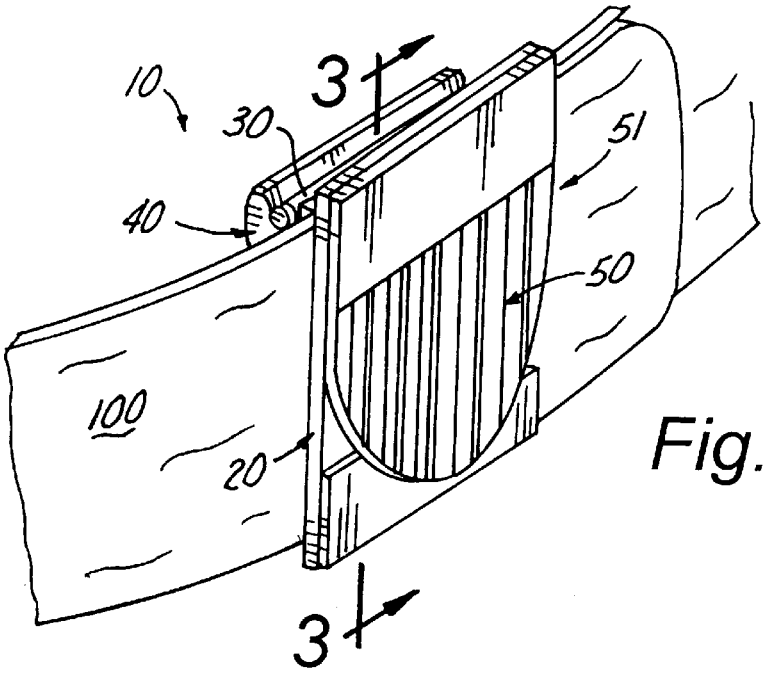
FIG. 1 is a perspective view of the belt clip construction disposed on a belt.

As can be seen by reference to the drawings, and in particularly to FIG. 1, the adjustable belt clip construction that forms the basis of the present invention is designated generally by the reference number 10. The belt clip construction 10 comprises in general, a belt clip unit 11 and a decorative face plate unit 12. These units will now be described in seriatim fashion.

Figure 2:
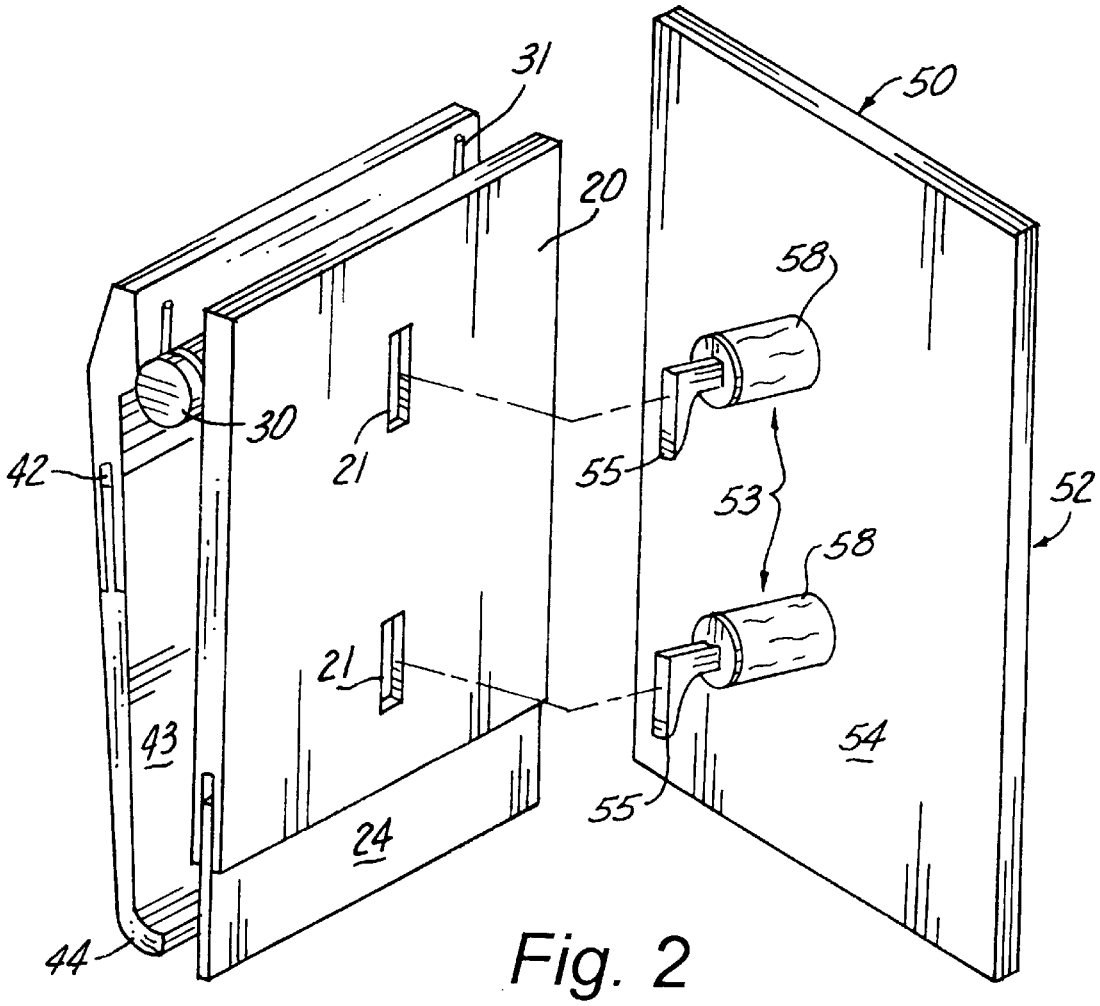
FIG. 2 is an exploded perspective view of the belt clip construction.
Figure 3:
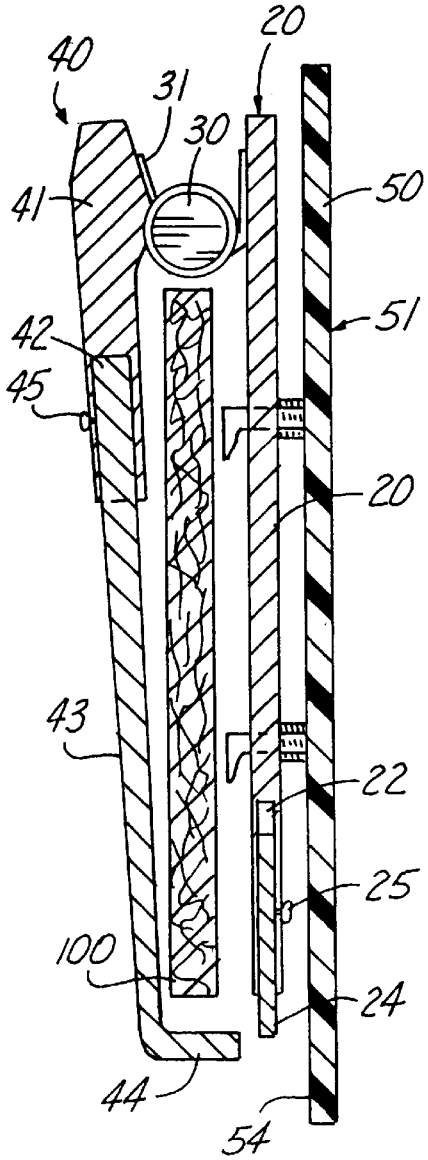
FIG. 3 is a cross sectional view taken through line 3—3 of FIG. 1.
Figure 4:
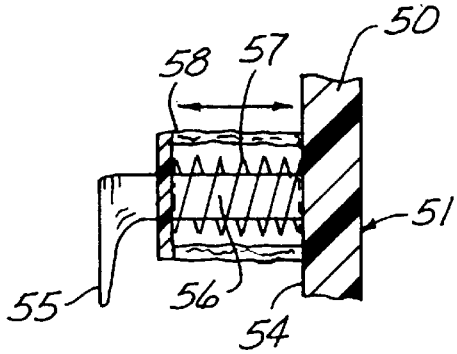
FIG. 4 is an isolated detail view of one of the spring loaded catch elements on the decorative face plate unit.

As shown in FIGS. 2 and 3, the belt clip unit comprises in general, an adjustable length backing plate member 20 provided with a plurality of vertically aligned mounting slots 21 wherein the lower end of the backing plate member 20 is provided with a recess 22 dimensioned to receive a backing plate extension element 24 whose purpose and function will be described in greater detail further on in the specification.

As can also be seen by reference to FIGS. 2 and 3, the backing plate member 20 is hingedly connected on its upper end by a hinge member 30 having a biasing spring 31 to the upper portion 41 of an adjustable length clip member 40. The upper portion 41 of the clip member 40 is provided with a recess 42 that is dimensioned to receive a clip extension element 43 having a hooked lower end 44 adapted to engage the bottom of a belt 100.

In addition, both the backing plate member 20 and the clip member 40 are provided with discrete set screws 25 and 45 respectively, to captively engage both of the extension elements 24 and 43 in their respective recesses 22 and 42 at a selected height to vary the effective height of the belt clip unit 11 to accommodate different width belts 100.

Turning now to FIGS. I through 4, it can be seen that the decorative face plate unit 12 comprises a decorative plate member 50 having a decorative design 51 formed on the front face 52 and a plurality of generally L-shaped catch elements 53 provided on the rear face 54.

Figure 5:
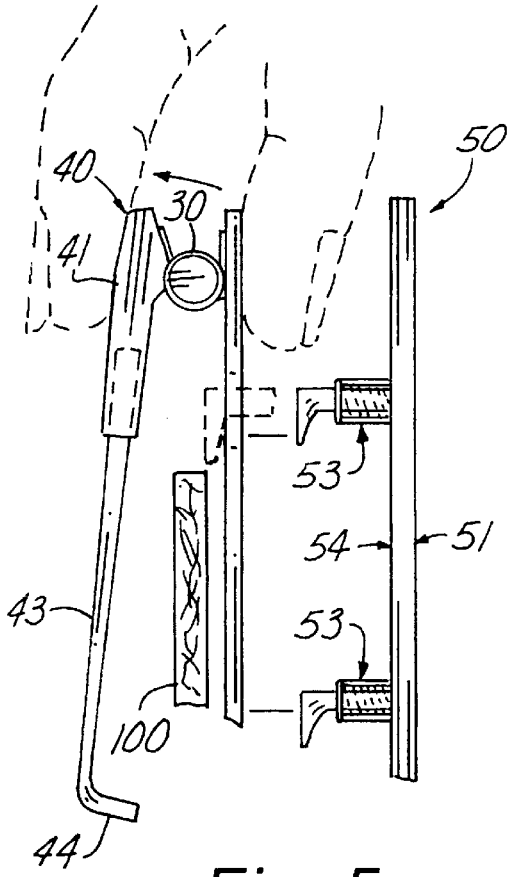
FIG. 5 is a side plan view illustrating the detachable engagement between the belt clip unit and a belt and the detachable engagement between the belt clip unit and the face plate unit.

Furthermore, each of the L-shaped catch elements 53 have a foot portion 55 dimensioned to be received in one of the slots 21 in the backing plate member 20. The leg portion 56 of catch element 53 is surrounded by a coiled spring 57 disposed within a collapsible collar element 58 such that when the decorative plate member 50 is to be engaged with the backing plate member 20, the user inserts the catch elements 53 into the slots 21 as illustrated in FIGS. 2 and 5 which forces the collapsible collar elements 58 away from the foot portion 55 of the catch elements 53. The decorative plate member 50 is then moved downwardly relative to the backing plate member 20. Then once the pressure on the decorative plate member 50 is released, the coiled springs 57 will force the collapsible collar elements 58 into gripping engagement with the backing plate member 50.

By now it should be appreciated that the belt clip construction 10 of this invention has a clip unit wherein both the front and rear portions of the clip unit can be elongated to accommodate belts 100 having different widths. Furthermore, while the drawings only disclose a limited adjustability that is for illustration purposes only, and a much wider range of adjustability would be achieved by deepening the recesses 22 and 42, as well as lengthening the upper portion 41 of the clip member 40 and the extension element 24.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A belt clip construction for belts having different widths wherein the belt clip construction comprises:

a main clip unit including an adjustable length clip member having an upper portion and a lower portion movable relative to said upper portion to vary the effective length of said clip member; a backing plate member hingedly connected to the clip member and having an upper portion and a lower portion provided with a recess; and a second extension element dimensioned to be slidably received in the recess in the lower portion of the backing plate member; and a decorative plate unit including a decorative plate member having a front face provided with a decorative design and having a rear face adapted to releasably engage said backing plate member.

2. The construction as in claim 1 wherein the main clip unit further comprises:

a hinge member provided with a biasing spring and operatively disposed between the clip member and the backing plate member.

3. The construction as in claim 2 wherein the lower portion of the clip member is provided with a first extension element that is slidably received relative to the clip member.

4. The construction as in claim 3 wherein the first extension element is provided with a hooked lower end dimensioned to engage the bottom of a belt.

5. The construction as in claim 3 wherein the backing plate member is provided with at least one slot and the rear face of the decorative face plate member is provided with at least one releasable catch element dimensioned to be received in said at least one slot.

6. The construction as in claim 5 wherein the at least one catch element has a generally L-shaped configuration including a foot portion dimensioned to be received in said at least one slot and a leg portion attached to the rear face of the decorative panel member.

7. The construction as in claim 6 wherein the leg portion of the catch element is surrounded by a coiled spring.

8. The construction as in claim 7 wherein said coiled spring is surrounded by a collapsible collar element.

* * * * *